United States Patent [19]

Walker

[11] Patent Number: 4,748,382

[45] Date of Patent: May 31, 1988

[54] ELECTRIC CIRCUIT ARRANGEMENT

[75] Inventor: Michael J. Walker, Halesowen, England

[73] Assignee: Lullas Industries Public Limited Company, Birmingham, England

[21] Appl. No.: 911,321

[22] Filed: Sep. 25, 1986

[30] Foreign Application Priority Data

Oct. 8, 1985 [GB] United Kingdom ..... 8524735

[51] Int. Cl.[4] ..... H05B 41/32

[52] U.S. Cl. ..... 315/241 P; 315/241 S; 315/240; 315/173; 354/418; 328/66

[58] Field of Search ..... 315/241 P, 241 R, 241 S, 315/240, 173; 354/418, 128, 145; 328/66, 67, 68

[56] References Cited

U.S. PATENT DOCUMENTS

| | | | |
|---|---|---|---|
| 3,286,128 | 11/1966 | Ward | 315/241 P |
| 3,846,750 | 5/1974 | Kearsley | 340/105 |
| 4,255,046 | 3/1981 | Corona | 315/241 P |
| 4,258,290 | 3/1981 | Nakajima | 315/241 P |
| 4,369,395 | 1/1983 | Stempeck | 315/241 P |
| 4,396,870 | 8/1983 | Ikeda | 315/241 P |
| 4,467,248 | 8/1984 | Watanabe et al. | 315/241 P |
| 4,486,691 | 12/1984 | Beggs | 315/241 P |

FOREIGN PATENT DOCUMENTS

| | | | |
|---|---|---|---|
| 2007047 | 5/1979 | United Kingdom | 315/241 P |
| 2142486 | 1/1985 | United Kingdom . | |
| 2155710 | 9/1985 | United Kingdom . | |
| 2168554 | 6/1986 | United Kingdom . | |

*Primary Examiner*—David K. Moore
*Assistant Examiner*—Michael Razavi
*Attorney, Agent, or Firm*—Nixon & Vanderhye

[57] ABSTRACT

An electric circuit arrangement for use in energising a flash tube (3) to provide a series of pairs of flashes, each pair consisting of a main flash and a rapidly following second flash, includes first and second capacitors (C9, C10) which are controlled to effect discharge of first only the first capacitor (C9) and then both the first and second capacitors (C9, C10) across the flash tube (3), cyclically, to provide the two flashes of each pair, in series. By varying the relative values of the first and second capacitors (C9, C10) the time interval between the flashes of each pair can be varied. All flashes produced can have the same peak intensity while the flashes in each pair can have different energy contents.

4 Claims, 2 Drawing Sheets

ELECTRIC CIRCUIT ARRANGEMENT

This invention relates to an electric circuit arrangement, and particularly to an electric circuit arrangement for use in energising a load such as a flash tube, for example to provide a warning beacon.

Warning beacons are known in which a flash tube is energised to provide a series of pairs of flashes, each pair consisting of a main flash and a rapidly following second flash.

With such a beacon the first flash of each pair attracts the attention while the second flash of the pair helps in location of the beacon.

Various electric circuit arrangements for providing a series of energising pulses to a flash tube are known.

In U.S. Pat. No. 3,286,128 there is disclosed such a circuit arrangement for use in energising a flash tube for use in stroboscopy or flash/photography. This known arrangement suffers from the disadvantage that it uses only passive components including an inductor which limits the intensity of the flashes produced and their spacing since otherwise an inductor of prohibitively large size would be required.

Further, this known arrangement can produce only flashes of equal energy level which is not essential for warning beacons.

According to this invention there is provided an electric circuit arrangement for use in energising a flash tube, comprising a trigger circuit arranged to supply a voltage to a trigger electrode of the tube sufficient to cause the tube to strike; first and second capacitors connected across the tube; and a charging and discharging network connected to the first and second capacitors and operative to effect charging of both the first and second capacitors, and discharging of only the first capacitor and then both the first and second capacitors together, alternately, into the tube when triggered, thereby to cause the tube to provide a series of pairs of flashes.

Preferably, the first capacitor is connected directly across the tube, and the second capacitor is connected across the tube in series with a switchable network. The network may comprise a parallel arrangement of a diode and a controlled rectifier or a triac. The controlled rectifier or triac may be switched by a transistor having its emitter collector path connected across a low voltage supply via a series resistor, its collector connected to the switching electrode of the controlled rectifier or triac, and its base connected to the junction between a diode and resistor, which junction is also connected to the junction between the second capacitor and the switchable network by way of a series arrangement of a third capacitor and a resistor. Preferably, a high voltage supply for the tube is derived from the low voltage supply.

In another arrangement the controlled rectifier or triac is switched by a digital counter which allows the switchable network to remain non-conductive for a plurality of charge and discharge cycles for the first and second capacitors.

This invention will now be described by way of example with reference to the drawings, in which.

Figure 1:
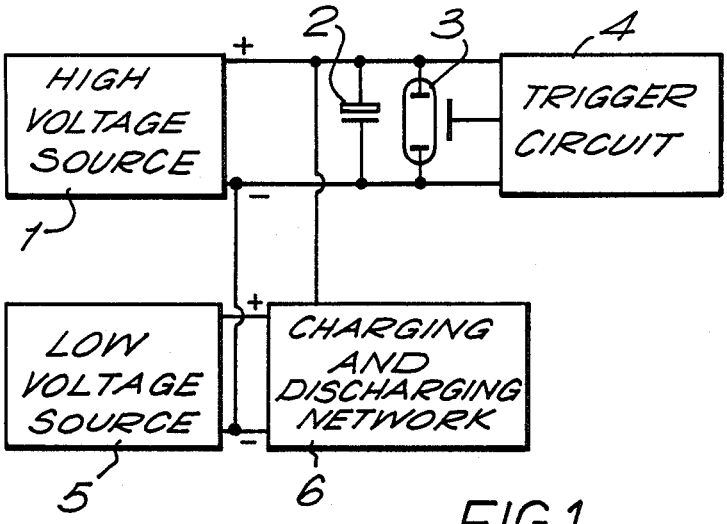
FIG. 1 is a block schematic diagram of a circuit arrangement according to the invention.

Referring to FIG. 1, the arrangement to be described comprises a high voltage source 1 connected across a parallel arrangement of a capacitor 2 and a flash tube 3, a trigger circuit 4 arranged to trigger the tube 3, a low voltage source 5 and a charging and discharging control circuit arrangement 6 energised by the low voltage source 5 and arranged to control energisation of the tube 3 by the high voltage source 1.

The high voltage source 1 can be obtained from the low voltage source 5 by means of an inverter, or otherwise they can be separate sources.

The trigger circuit 4 comprises a potential divider formed by resistors R11, R12, and R13 connected in series across the high voltage supply, the junction A between the resistors R11 and R12 being connected to the negative supply line by a controlled rectifier SCR1 and by way of a series arrangement of a capacitor C7 and the primary winding of a transformer T2. The junction between the resistors R12 and R13 is connected by way of a neon N1 to the negative supply line via a resistor and to the switching electrode of the controlled rectifier SCR1. The secondary winding of the transformer T2 is connected between the negative supply line and the trigger electrode of the tube 3.

The control circuit arrangement 6 comprises a first capacitor C9 connected directly across the tube 3 (that is across the high voltage supply), and a second capacitor C10 connected in series with a switchable network comprising a parallel arrangement of a diode D8 and a controlled rectifier SCR2, across the tube 3. The switching electrode of the controlled rectifier SCR2 is connected to the collector of a transistor Q6 having its emitter-collector path connected in series with a resistor R16 across the low voltage supply, and its base connected to the junction between a diode D9 and a resistor R17 also connected in series across the low voltage supply. The junction between the capacitor C10 and the controlled rectifier SCR2 is connected by way of a resistor R15 and a capacitor C11 to the junction between the diode D9 and the resistor R17.

In use the high voltage supply will charge up capacitors C9 and C10 at a rate dependent upon the output impedance of the supply and the values of the capacitors; the value of capacitor C9 may be less than that of the capacitor C10. The high voltage is also present across the tube 3 which can be a conventional tube filled with Xenon gas at low pressure.

As the voltage at point A rises, capacitor C7 charges through the primary winding of transformer T2. At a predetermined voltage neon N1 will strike raising the voltage across resistor R14 and switching on controlled rectifier SCR1. This discharges capacitor C7 through the primary winding of transformer T2 and the voltage thereby induced in the secondary winding is applied to the trigger electrode of the tube 3.

When the arrangement is first switched on transistor Q6 is held conductive by the current through resistor R17, and holds controlled rectifier SCR2 non-conductive. The high voltage supply charges capacitor C9, and also capacitor C10 by way of resistor R15, capacitor C11 and the base-emitter junction of the transistor Q6; capacitor C11 is of much smaller value than capacitor C10, and thus the voltage across C10 will be very small.

When the trigger circuit operates as described above and a triggering voltage is applied to the trigger electrode of the tube 3 the capacitor C9 will discharge through the tube and cause it to flash. The voltage across capacitor C9 then collapses and transistor Q6 is rendered non-conductive. Diode D9 serves to limit reverse biasing of the base-emitter junction of transistor Q6 and can be omitted if an appropriate transistor is used. When transistor Q6 is rendered non-conductive the rectifier SCR2 is rendered conductive via resistor R16.

The charging cycle now starts again, with capacitor C10 being charged via controlled rectifier SCR2 in addition to capacitor C9 being charged.

After a short period of time the charge on capacitor C11 decays to a point where transistor Q6 is allowed to become conductive while controlled rectifier SCR2 remains conductive due to charging current following into capacitor C10.

When the trigger circuit again triggers the tube 3, capacitor C9 discharges into the tube 3 while capacitor C10 discharges into the tube via diode D8, thus rendering rectifier SCR2 non-conductive.

When charging recommences transistor Q6 is conductive, and thus only capacitor C9 charges. The circuit arrangement thus automatically alternates between discharging capacitor C9 only and capacitors C9 and C10 together, into the tube 3.

Figure 3:
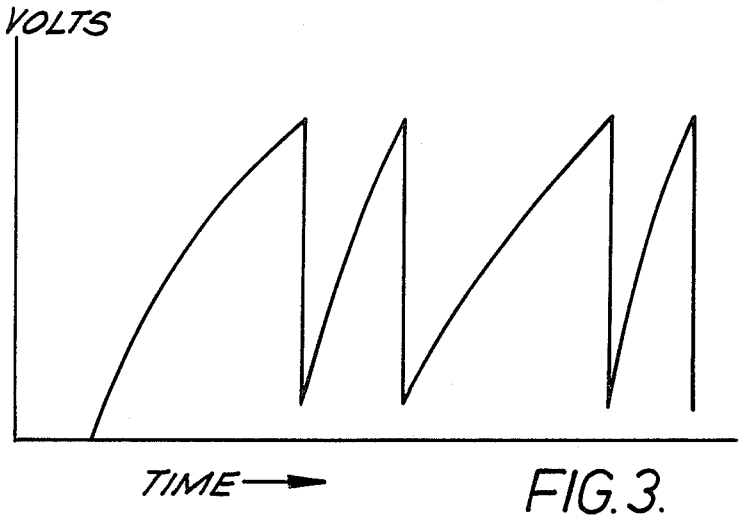
FIG. 3 is a diagram illustrating the voltage waveform across the tube of FIGS. 1 and 2.
Figure 2:
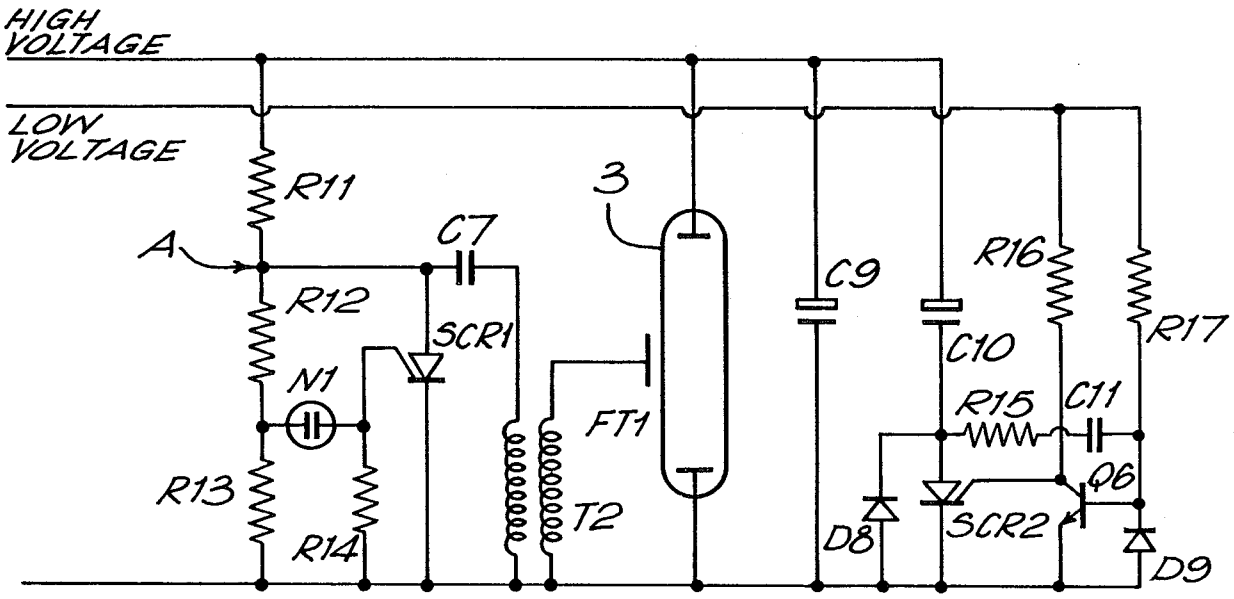
FIG. 2 is a circuit diagram of the arrangement of FIG. 1.

The voltage waveform occurring across the tube 3 is shown in FIG. 3.

The arrangement of diode D8 and rectifier SCR2 can be replaced by a triac.

The circuit arrangement of the invention has the following advantages.

1. The arrangement always triggers at the same voltage so the peak intensity of each flash is approximately the same, while the energy content of the two flashes of each pair can be different (as shown in FIG. 3).

2. No bi-stable circuit is needed, as in known arrangements, as the arrangement operates automatically.

3. The time interval between flashes can be varied over a very wide range by varying the relative values of the first and second capacitors (C9 and C10). Very fast second flashes can therefore be achieved.

4. The second capacitor (C10) which can have the larger value operates for only part of the time, and can therefore have a lower average ripple current rating.

5. The flash tube can always operate at its ideal voltage rating which achieves long life.

6. Calibration is simple as only one strike voltage needs to be set.

The arrangement may be adapted to produce multiple flashes if transistor Q6 is replaced by a digital counter which allows rectifier SCR2 to remain off for a predetermined number of counts. This enables a high energy flash followed by a series of low energy flashes to be produced.

If a separate counter circuit is used, rectifier SCR2 may be replaced by a high voltage transistor if required.

I claim:

1. A warning beacon comprising: a flash tube arranged to provide a series of pairs of flashes, one flash of each pair being of relatively longer duration and larger energy content, the other being of relatively shorter duration and lower energy content, both flashes having the same peak intensity; an electric circuit arrangement connected to the flash tube comprising a trigger circuit arranged to supply a voltage to a trigger electrode of the tube sufficient to cause the tube to strike; a first capacitor connected directly across the tube and a second capacitor connected across the tube in series with a switchable network comprising a parallel arrangement of a diode and controlled rectifier, the controlled rectifier being switched by a transistor, the emitter collector paths of the transistor being connected across a low voltage supply via a series resistor, the collector of the transistor being connected to the controlled rectifier, and the base of the transistor being connected to the junction between a diode and a resistor, which junction is also connected to the junction between the second capacitor and the switchable network by way of a series arrangement of a third capacitor and a resistor; a charging and discharging network connected to the first and second capacitors and operative to effect charging of both the first and second capacitors and discharging of only the first capacitor and then both the first and second capacitors together, alternately into the tube when triggered, thereby to cause a series of said pairs of flashes, the time interval between the flashes being varied by varying the relative values of the capacitors.

2. An arrangement as claimed in claim 1, in which the controlled rectifier is switched by a digital counter which allows the switchable network to remain non-conductive for a plurality of charge and discharge cycles for the first and second capacitors.

3. A warning beacon comprising: a flash tube arranged to provide a series of pairs of flashes, one flash of each pair being of relatively longer duration and larger energy content, the other being of relatively shorter duration and lower energy content, both flashes having the same peak intensity; an electric circuit arrangement connected to the flash tube comprising a trigger circuit arranged to supply a voltage to a trigger electrode of the tube sufficient to cause the tube to strike; a first capacitor connected directly across the tube and a second capacitor connected across the tube in series with a switchable network comprising a parallel arrangement of a diode and triac, the triac being switched by a transistor, the emitter collector paths of the transistor being connected across a low voltage supply via a series resistor, the collector of the transistor being connected to the triac, and the base of the transistor being connected to the junction between a diode and a resistor, which junction is also connected to the junction between the second capacitor and the switchable network by way of a series arrangement of a third capacitor and a resistor; a charging and discharging network connected to the first and second capacitors and operative to effect charging of both the first and second capacitors and discharging of only the first capacitor and then both the first and second capacitors together, alternately into the tube when triggered, thereby to cause a series of said pairs of flashes, the time interval between the flashes being varied by varying the relative values of the capacitors.

4. An arrangement as claimed in claim 3, in which the triac is switched by a digital counter which allows the switchable network to remain non-conductive for a plurality of charge and discharge cycles for the first and second capacitors.

* * * * *